US006055839A

United States Patent [19]

Hughson

[11] Patent Number: 6,055,839

[45] Date of Patent: May 2, 2000

[54] PRESSING OF COINS, TOKENS, AND LIKE ITEMS

[76] Inventor: Alexander W. Hughson, 930 Huber St., Grover Beach, Calif. 93433

[21] Appl. No.: 09/183,485

[22] Filed: Oct. 30, 1998

Related U.S. Application Data

[60] Provisional application No. 60/064,715, Nov. 6, 1997.

[51] Int. Cl.[7] ..... B21D 43/16

[52] U.S. Cl. ..... 72/428; 72/198; 72/199; 72/250; 72/365.2; 72/377; 273/138.1; 273/138.4; 101/5

[58] Field of Search ..... 72/176, 177, 182, 72/190, 191, 196–199, 207, 250, 365.2, 366.2, 377, 428; 273/138.1, 138.2, 138.3, 138.4, 142 R, 143 A, 144 R; 101/5, 6, 7, 22, 36, 37, 38.1; 194/344, 346; 453/18, 19; 222/2

[56] References Cited

U.S. PATENT DOCUMENTS

| | | | |
|---|---|---|---|
| 693,241 | 2/1902 | Crowe . | |
| 1,937,500 | 12/1933 | Barnard | 273/138.1 |
| 2,417,537 | 3/1947 | Wyckoff | 273/138.4 |
| 3,863,485 | 2/1975 | MacDonald et al. | 72/415 |
| 4,496,160 | 1/1985 | Wichinsky et al. | 273/369 |

*Primary Examiner*—Ed Tolan
*Attorney, Agent, or Firm*—Leo F. Costello

[57] ABSTRACT

A machine and method for producing pressed items from coins, tokens, and like items. The machine includes multiple operating stations from where multiple operators can activate the machine; a press adapted to press coins, tokens, and like items delivered to it and to release pressed items therefrom; multiple collecting stations adapted to receive items that have been pressed; a gating device that delivers items to be pressed to the press in a predetermined order and in response to activation of the machine at the operating stations; and a dispenser that delivers pressed items from the press to the collecting stations in a predetermined manner. The method involves activating the machine at multiple operating positions so that more than one coin- or token-to-be-pressed associated with different operating positions can be in the machine awaiting pressing at the same time; determining the order in which the operating positions were activated; and pressing the coins or tokens awaiting pressing in a predetermined order.

26 Claims, 17 Drawing Sheets

PRESSING OF COINS, TOKENS, AND LIKE ITEMS

CROSS REFERENCE TO RELATED APPLICATION

This application is a regular application based on my prior copending provisional application No. 60/064,715, filed Nov. 6, 1997, and entitled Multi Play Point Token/Coin Pressing Machine and which is incorporated in its entirety by reference herein.

FIELD OF INVENTION

The present invention pertains to the pressing of coins, tokens, and like items and more particularly to a method and machine for pressing such items into pressed coins, tokens, and like items.

BACKGROUND

Coin-operated, coin-pressing machines have been known and popular for more than one hundred years. These machines are usually found at theme parks, zoos, aquariums, fairs, and many other tourist attractions. A coin-pressing machine of the type referred to allows a customer to press a coin, such as a penny, into an elliptical shape and at the same time to emboss a design on the penny, thereby to allow the customer to obtain a souvenir item. Alternatively, the item-to-be-pressed may be a blank token provided by the machine when it is operated.

Modern coin-pressing machines are typically operated by inserting a payment coin, such as an American quarter, into a coin-receiving slot of the machine, like any vending machine. The coin-to-be-pressed may be inserted into the machine along with the payment coin, or alternatively, the machine may release a blank token-to-be-pressed in response to insertion of the payment coin. Thereafter, if the machine is electrically powered, the machine automatically produces the pressed souvenir and delivers it to a receptacle in the machine convenient for retrieval by the customer. Hand-crank models are still also in use.

The known coin-pressing machines have one position or station from which to operate the machine. In other words, only one customer can press his or her token at one time and only one coin or token can be successfully pressed at a time. If others wish to use the machine, they must wait in line. Since the business profitability of owning and operating such machines depends on their frequency of use, that is, on the number of coins or tokens that are pressed, and thus the number of payment coins that are received, over a given period, such serial use greatly reduces the throughput and the resultant profitability of the machine.

Although it thus is desirable to provide more than one station from which to operate the machine, the known machines are only single station machines. Operating such coin-pressing machines from multiple positions presents certain problems that must be solved for smooth operation. Of primary importance, it is imperative that only one coin or token be delivered to the press in any given pressing cycle. If more than one such item is in the press at the same time, the press will cause the items to be imperfectly pressed, typically resulting in a super elongated item that will have sharp and dangerous edges. Moreover, with multiple items simultaneously in the press, the drive motor may not possess sufficient power to complete the pressing operation, causing serious damage to the motor, the press, or both, or perhaps causing the machine to jam.

Controlling the movement of coins- or tokens-to-be-pressed through such a coin-pressing machine is thus very important, not only to provide a machine with multiple operating stations, but even for single station machines. If a coin-pressing machine jams or otherwise malfunctions, especially if it is a single-station machine, it produces no revenue until it has been repaired.

SUMMARY

A machine and method for producing pressed items from coins, tokens, and like items, is provided. The machine includes multiple operating stations from where multiple operators can activate the machine; a press adapted to press coins, tokens, and like items delivered to it and to release pressed items therefrom; multiple collecting stations adapted to receive items that have been pressed; a gating device that delivers items-to-be-pressed to the press in a predetermined order and in response to activation of the machine at the operating stations; and a dispenser that delivers pressed items from the press to the collecting stations in a predetermined manner. The method involves activating the machine at multiple operating positions so that more than one coin- or tokento-be-pressed associated with different operating positions can be in the machine awaiting pressing at the same time; determining the order in which the operating positions were activated; and pressing the coins or tokens awaiting pressing in a predetermined order.

An object of the present invention is to enable a coin or token pressing machine to be operated from multiple positions.

A further object is to establish an order of pressing coins or tokens in a multi-station coin pressing machine so that only one coin or token is pressed at a time.

Another object is to control the movements of coins- or tokens-to-be-pressed through a coin or token pressing machine so that the coins or tokens will be pressed substantially in the order in which they were released into the machine for pressing.

An additional object is to increase the throughput of a coin or token pressing machine.

Yet another object is to make the ownership and operation of a coin or token pressing machine more profitable.

A still further object is to minimize the wait for customers desiring to use a coin or token pressing machine at the same time.

Yet an additional object is to preclude admission of a successive coin or token into the machine before a preceding coin or token in the machine has reached a certain stage in its pressing cycle.

A still further object is to minimize damage and breakdown of a coin or token pressing machine or improper functioning of the machine caused by admission of more than one coin or token in the press of the machine at the same time.

Another object is to provide a coin or token pressing machine that produces pressed tokens that do not have sharp, jagged edges that may be dangerous for customers to handle.

An important additional object is to control a multi-station coin or token pressing machine with a programmable logic computer.

Yet a further object is to return a pressed token or coin to a customer of a coin or token pressing machine at a convenient place in the machine adjacent to where the customer originally operated the machine.

An additional object is to allow a customer of a coin or token pressing machine to select from several images or designs to be pressed on the coin or token.

Another object is to enable the item to be pressed by a coin pressing machine to be supplied by the customer operating the machine, or by the machine in response to the customer.

Yet another object is to allow customers to view items being pressed in a multi-position coin pressing machine.

These and other objects, features, and advantages of the present invention will become apparent upon reference to the following description, accompanying drawings, and appended claims.

DETAILED DESCRIPTION OF THE MACHINE

Figure 1:
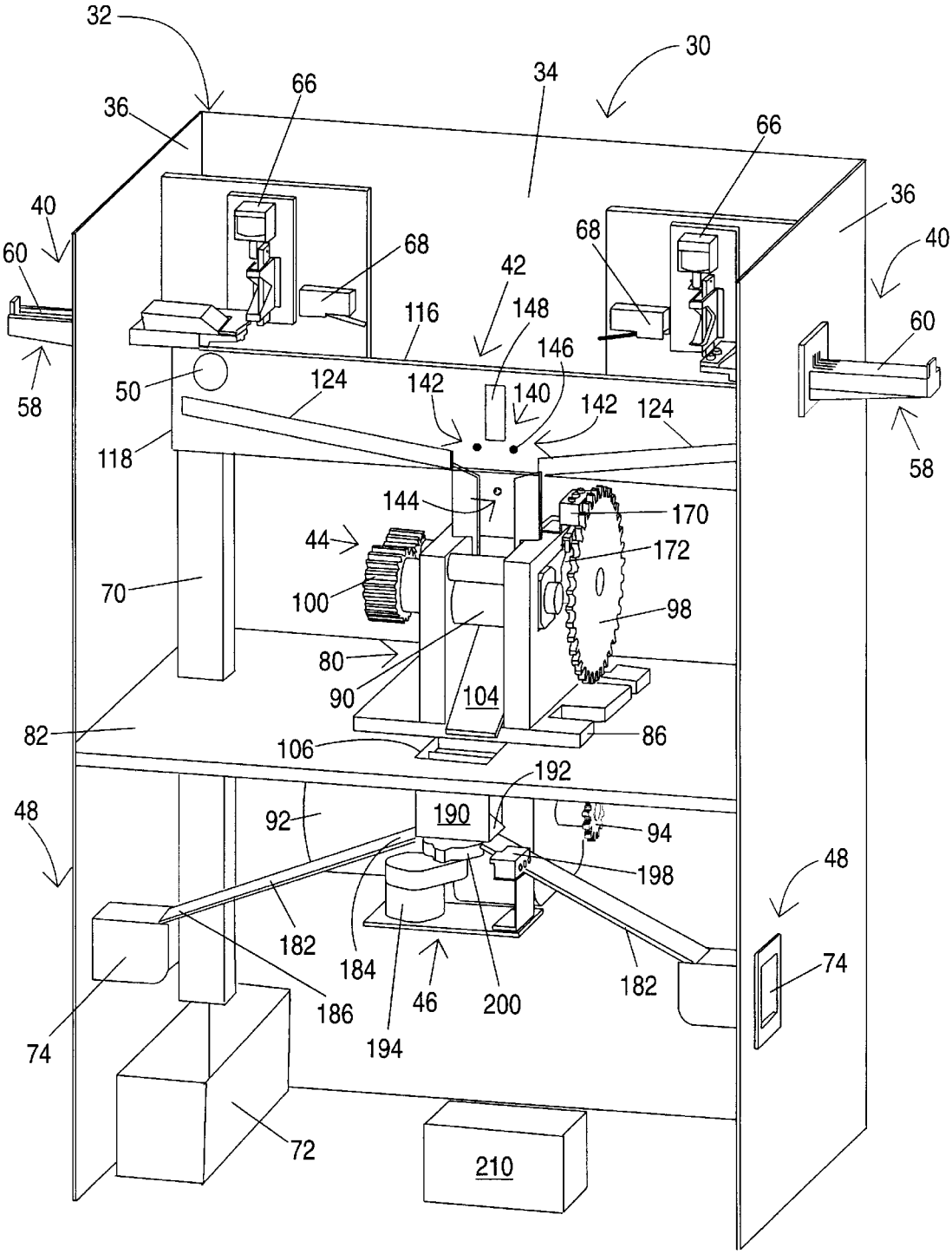
FIG. 1 is an isometric front view of an embodiment of the coin pressing machine of the present invention with cabinet walls removed to show the interior of the machine, with certain parts being shown in phantom, and with still other parts and their relationship being shown schematically.

The pressing machine of the present invention is generally indicated by the number 30 in FIG. 1. The machine includes a cabinet 32 having a back wall 34 and side walls 36. The top, front and bottom walls of the cabinet are removed in FIG. 1 and not shown so that the parts of the machine within the cabinet can be shown and described.

The subject pressing machine 30 (FIGS. 1 and 16) provides multiple upper operating stations 40, two in the disclosed embodiment, a gating station 42 located between and slightly below the operating stations, a pressing station 44 located centrally of the cabinet and slightly below the gating station, a dispensing station 46 under the pressing station, and multiple collecting stations of 48 slightly below and on opposite sides of the dispensing station so that there is a collecting station associated with and below each operating station. All of these stations are mounted in the cabinet with the operating and collecting stations being accessible by customers from the exterior of the cabinet.

Figure 17:
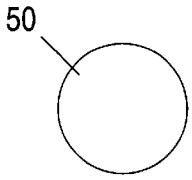
FIG. 17 is a plan view of a coin or token or other item-to-be-pressed, that is, before it has passed through the pressing station of the subject machine.
Figure 18:
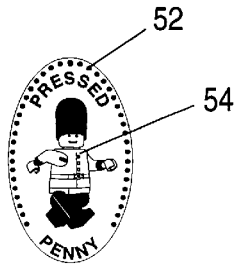
FIG. 18 is a plan view of a pressed token after having been pressed in the subject machine.

Before describing the details of the subject machine 30, reference is made to FIGS. 17 and 18 that respectively show a coin or token-to-be-pressed 50 in the subject machine and a pressed token 52 that has passed through the machine. As is believed understood, the general purpose of the subject machine is to enable a user of the machine to press a coin or a token, as 50, usually a flat circular coin like an American penny, into a further flattened, enlarged, pressed coin or token 52 with a design, words, and/or image, as 54, embossed on the coin or token. The user is allowed to operate the machine to obtain such a pressed coin or token for a small charge, such as a quarter, not shown, but received into the machine in a well known manner. The machine may be configured to allow the user to press a coin of the user's choosing, such as a penny, or to press a blank token that the machine supplies. Thus, the subject machine may press a coin, a token, or some other item that the machine will accept, as 50, albeit from different sources, into a pressed token, as 52.

For convenience of description, the items 50 (FIG. 17) that are to be pressed in the subject machine are generally referred to herein as coins, tokens, or just as "items" to-be-pressed. It will be understood, however, that the subject machine will press items that might not otherwise be characterized as a "coin" or a "token" but if they are of the size, shape and material that can be accepted and pressed by the machine, they are included within the definition of a coin or a token as used herein. In general, the items to-be-pressed will be similar in size, shape, and material to an American penny, but it will be understood that the invention is not limited to these exact characteristics.

Likewise, although the output of the machine is sometimes referred to as a pressed token, as 52, the item received by the customer may be termed a pressed token, a pressed coin, or simply, a souvenir. The point here is that the actual nomenclature applied to the input items or the output items do not change the character of the machine and its function, as is believed understood. For description convenience herein, the items to be pressed in the embodiment of the machine shown in FIGS. 1–16 will be referred to as "unpressed coins" and the pressed items produced in this embodiment will be referred to as "pressed coins." By "unpressed," it will be understood that the item has not been pressed in the subject machine without regard to whether it was previously subjected to any pressing operation prior to its entry into the subject machine. Different nomenclature will be used for the embodiment of FIGS. 20 and 21, as will be described. As previously explained however, the input item in either embodiment or in other machines based on the principles of the present invention may be a coin, a token, or similar item.

Figure 2:
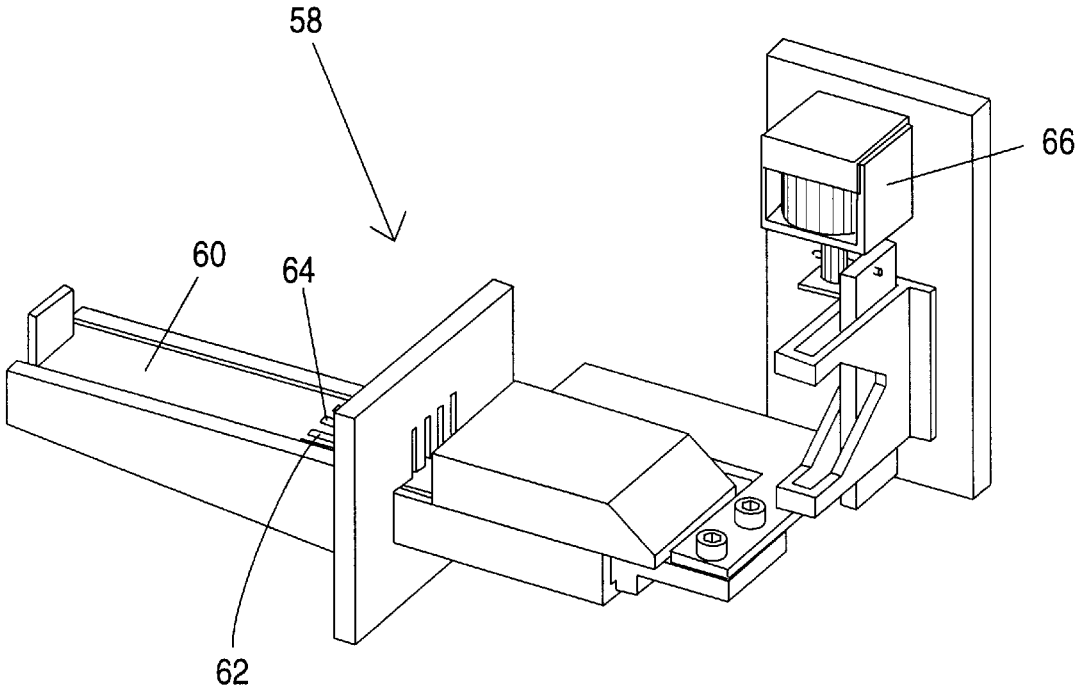
FIG. 2 is an enlarged isometric view of the left-hand operating station shown in FIG. 1 especially to show the coin-receiving tray and the lock-out mechanism.
Figure 3:
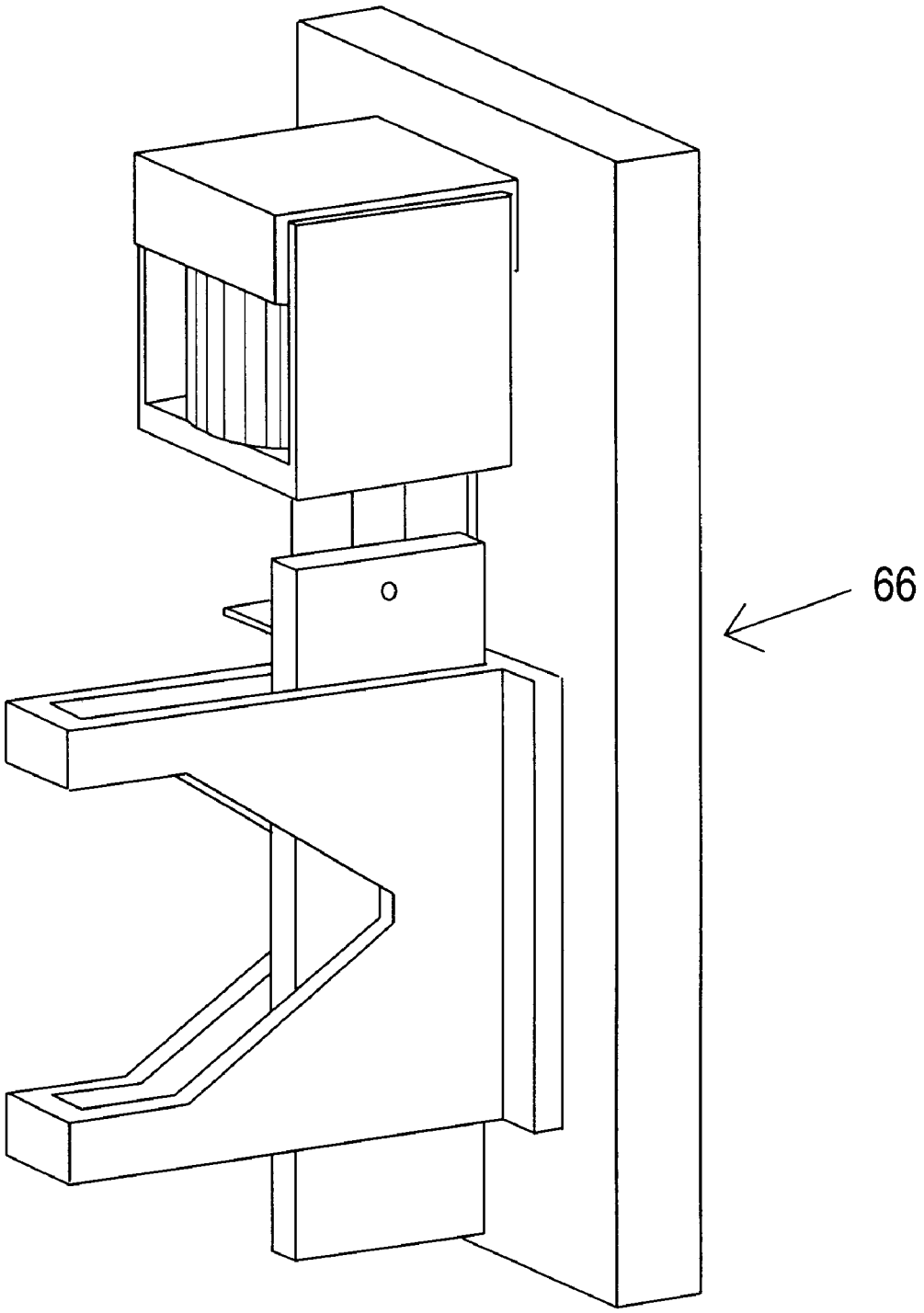
FIG. 3 is an enlarged isometric view of the lock-out mechanism shown in FIG. 2.
Figure 4:
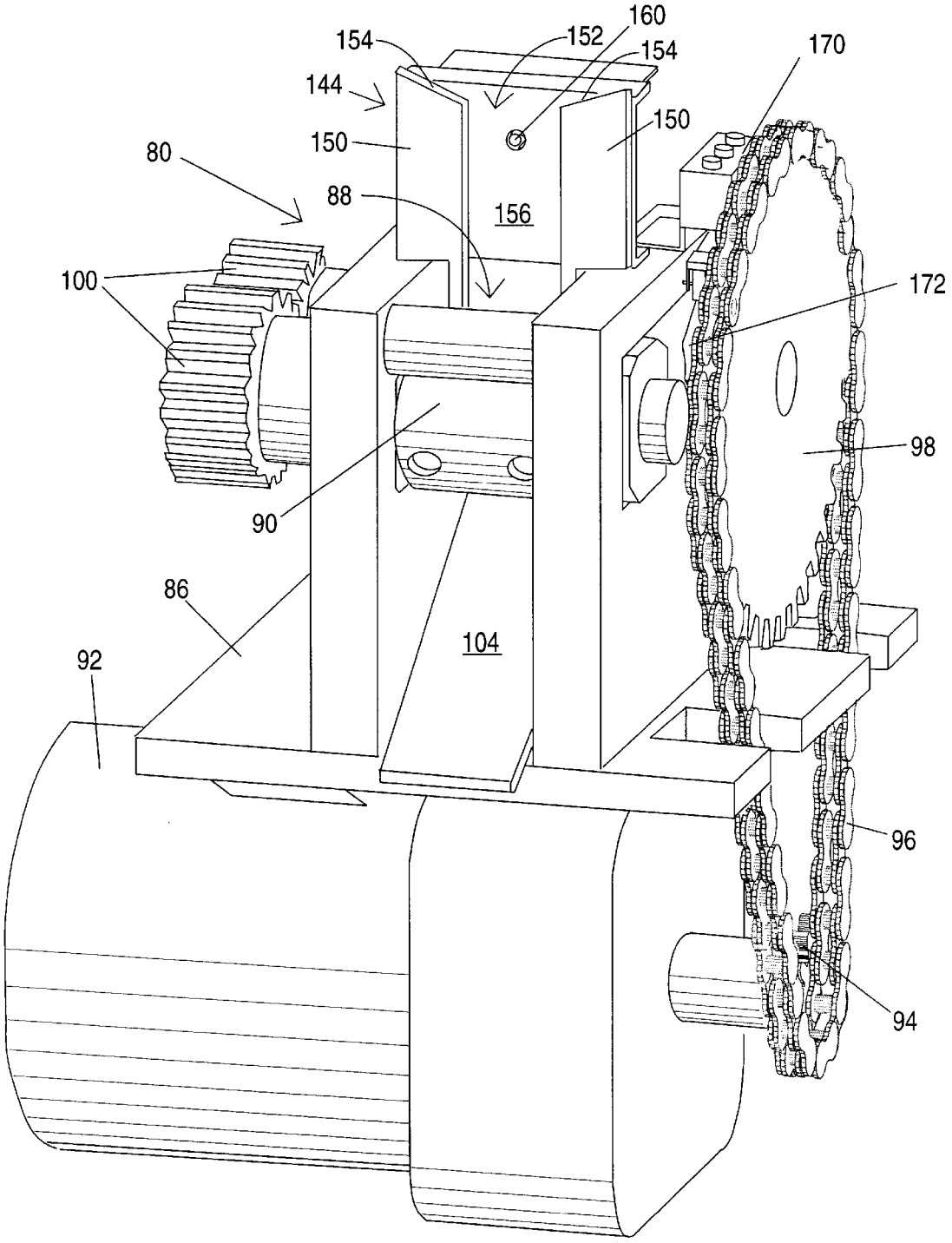
FIG. 4 is an enlarged isometric front view of the press and drop-timing gate that are shown in FIG. 1.
Figure 5:
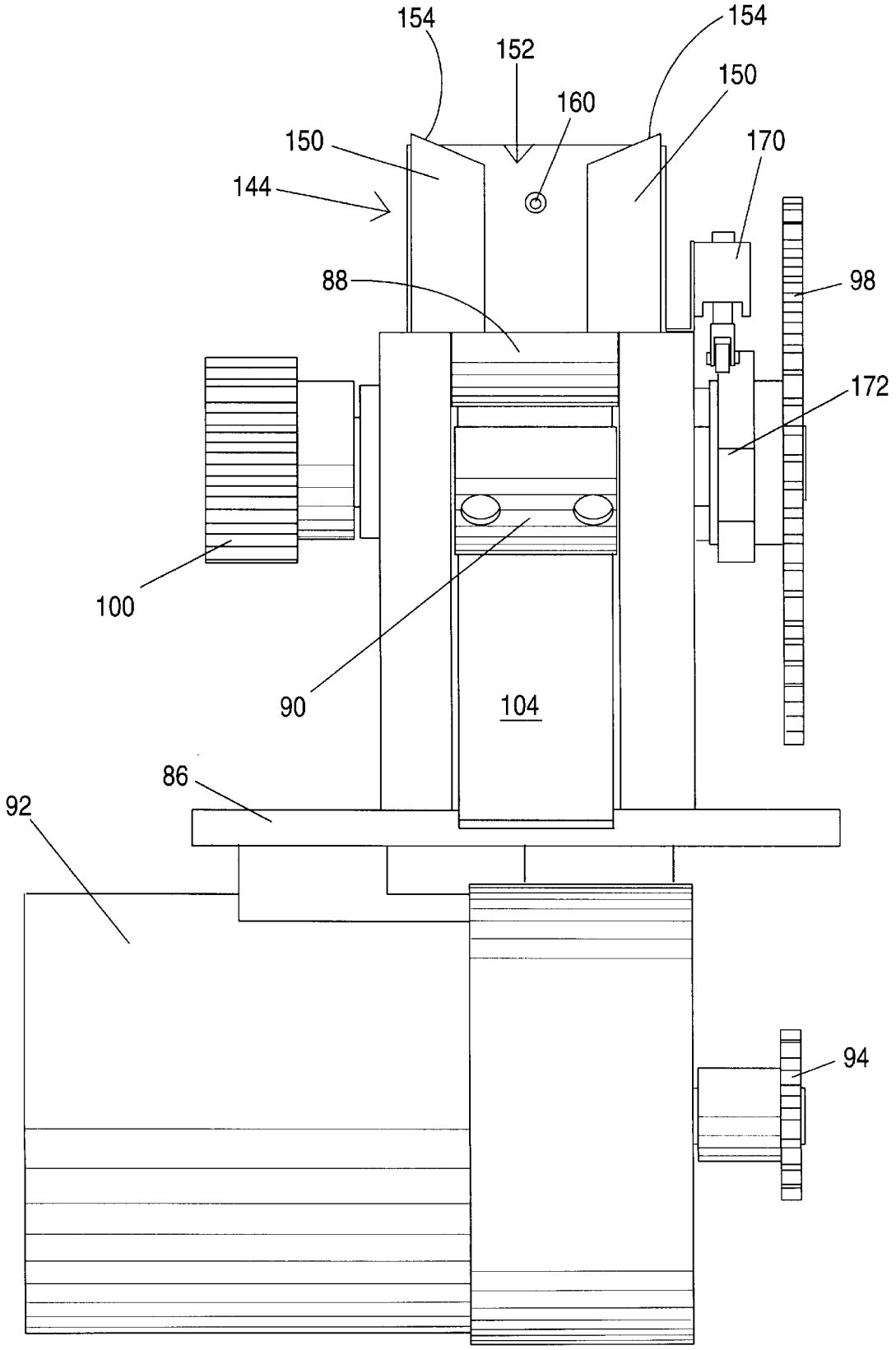
FIG. 5 is a front elevation of the press and drop-timing gate shown in FIG. 4.
Figure 6:
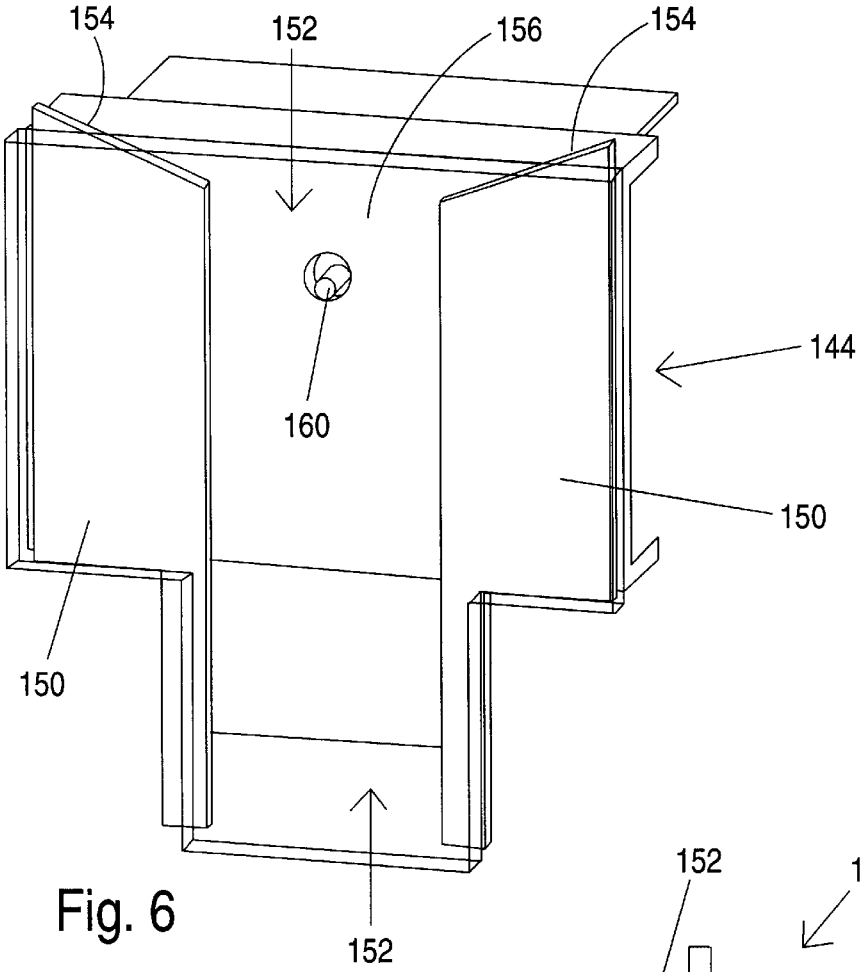
FIG. 6 is a still further enlarged isometric view of the drop-timing gate shown in FIGS. 4 and 5.
Figure 7:
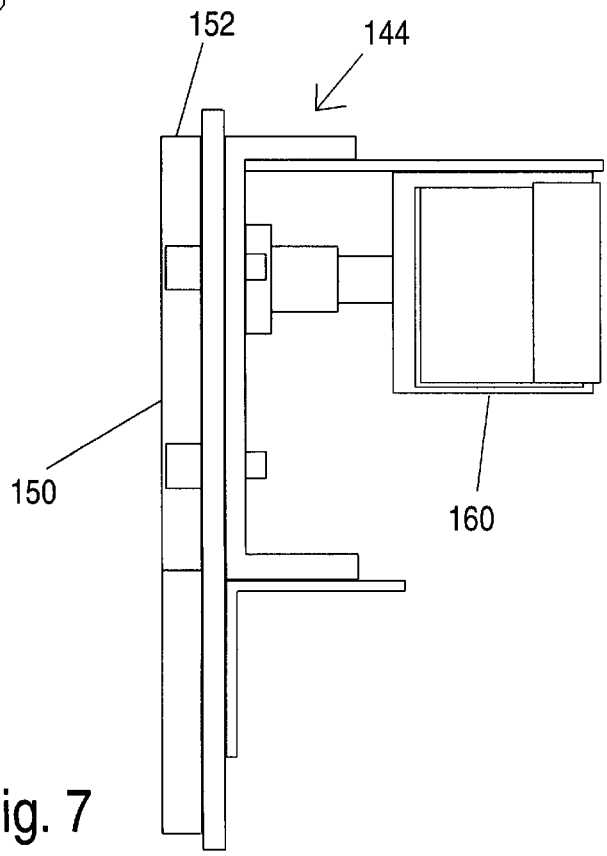
FIG. 7 is a side elevation of the drop-timing gate shown in FIG. 6.
Figure 8:
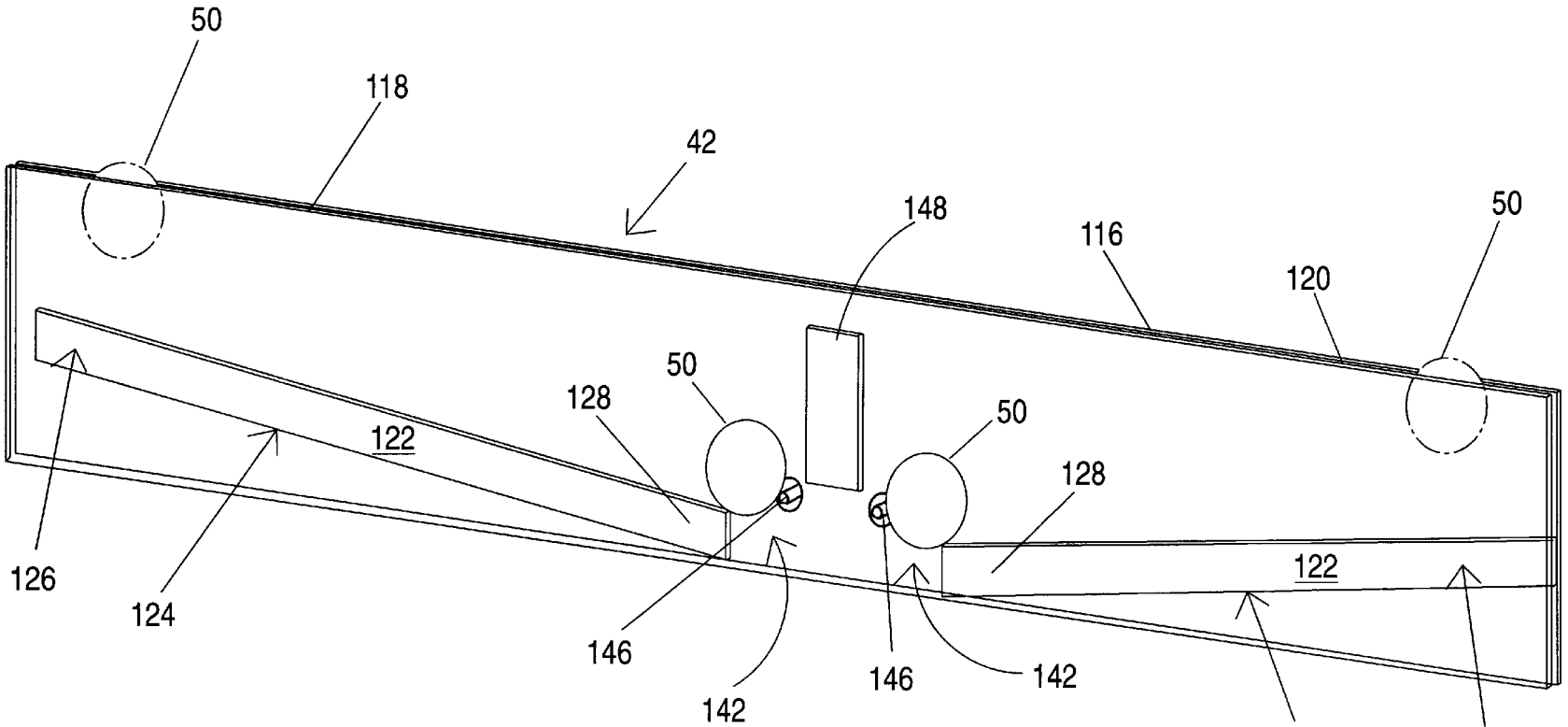
FIG. 8 is an enlarged front isometric view of the delivery chutes and the holding gates shown in FIG. 1, with two coins- or tokens-to-be-pressed shown in holding positions and these same two coins- or tokens-to-be-pressed shown in phantom to indicate how they dropped onto the delivery chutes after they were inserted into the machine.
Figure 9:
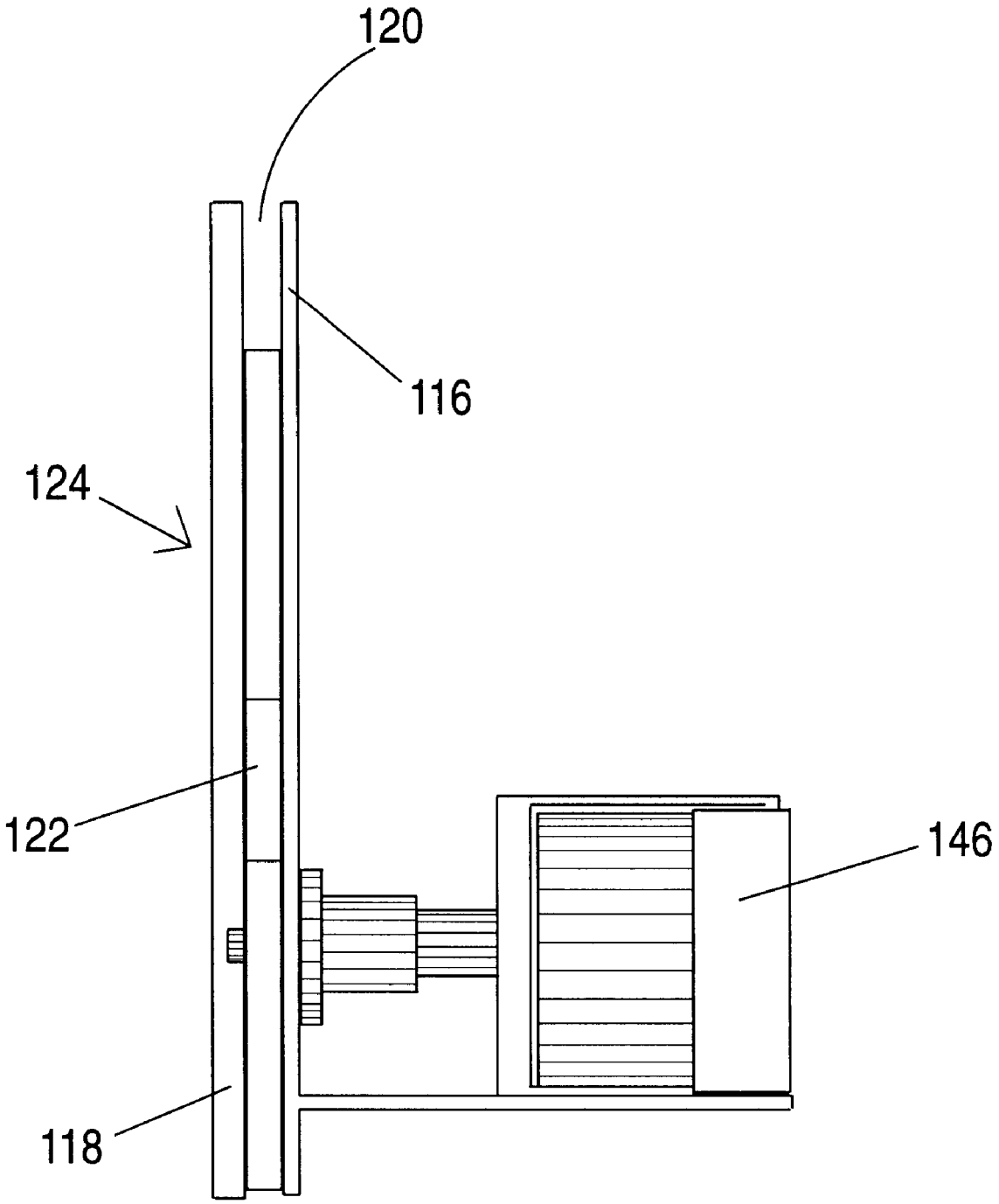
FIG. 9 is a side elevation of the delivery chutes and holding gates shown in FIG. 8.
Figure 10:
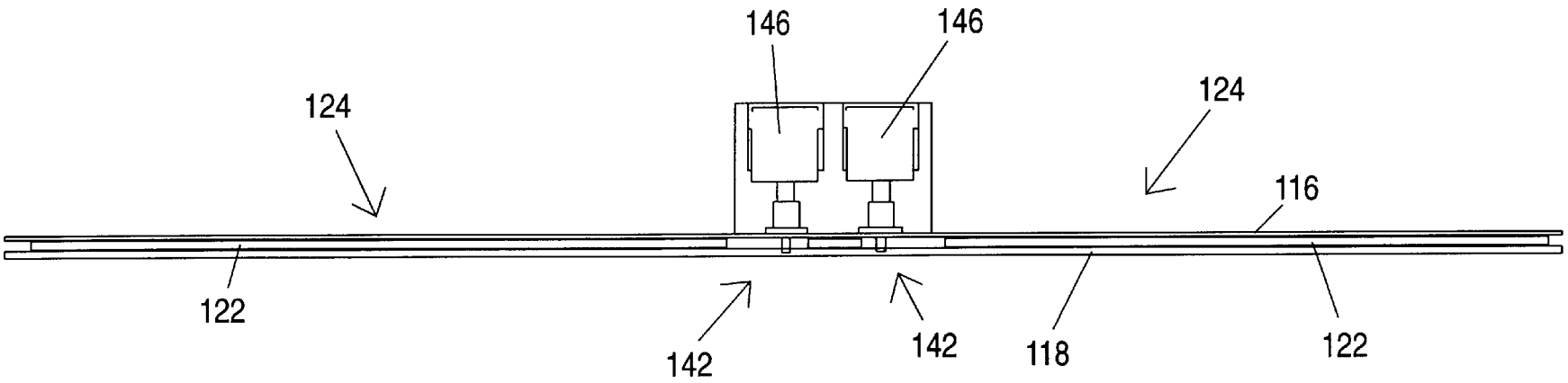
FIG. 10 is a top plan view of the delivery chutes and holding gates shown in FIGS. 8 and 9, although on a somewhat reduced scale from FIG. 9.
Figure 11:
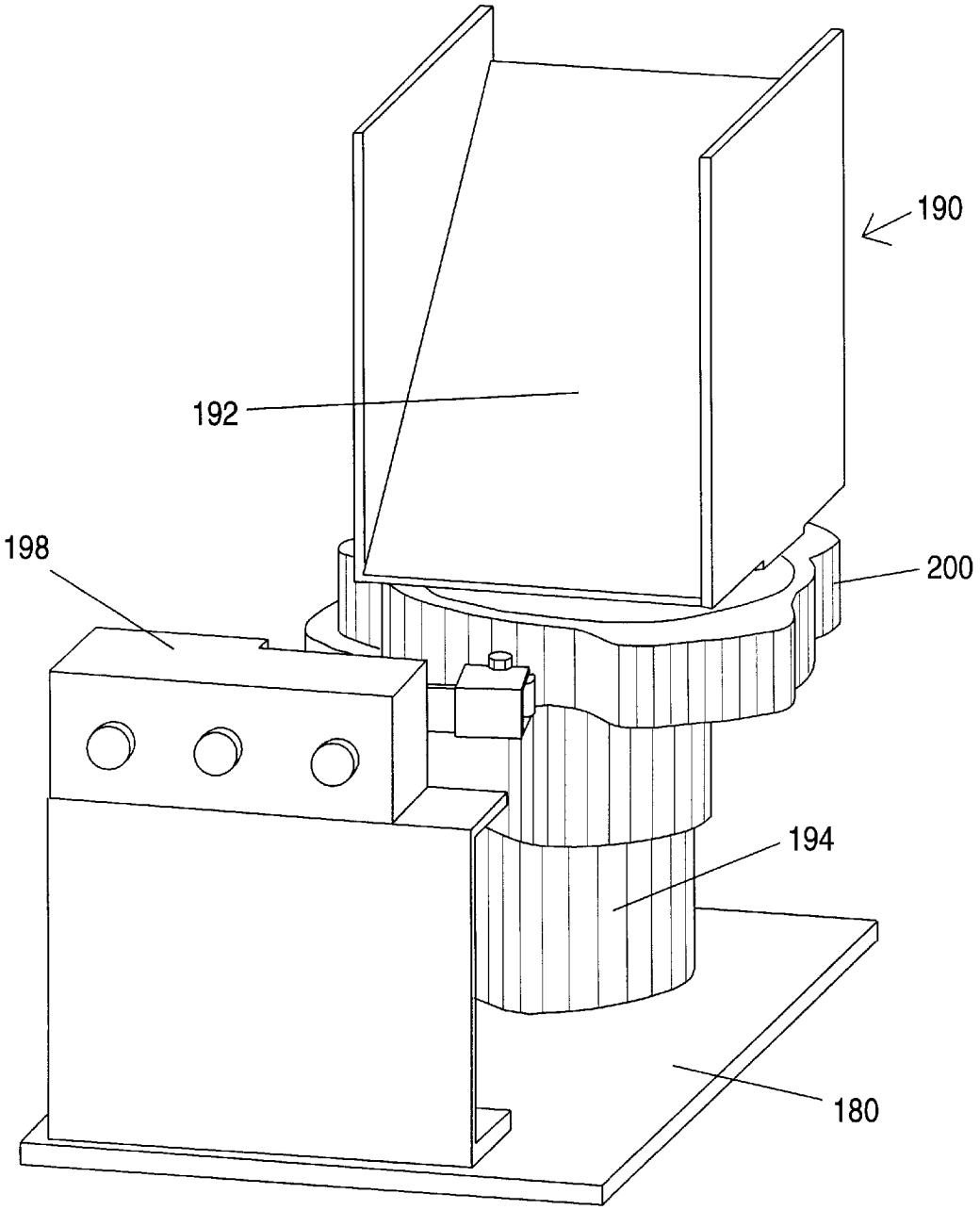
FIG. 11 is an enlarged isometric side view of the dispensing station shown in FIG. 1.
Figure 12:
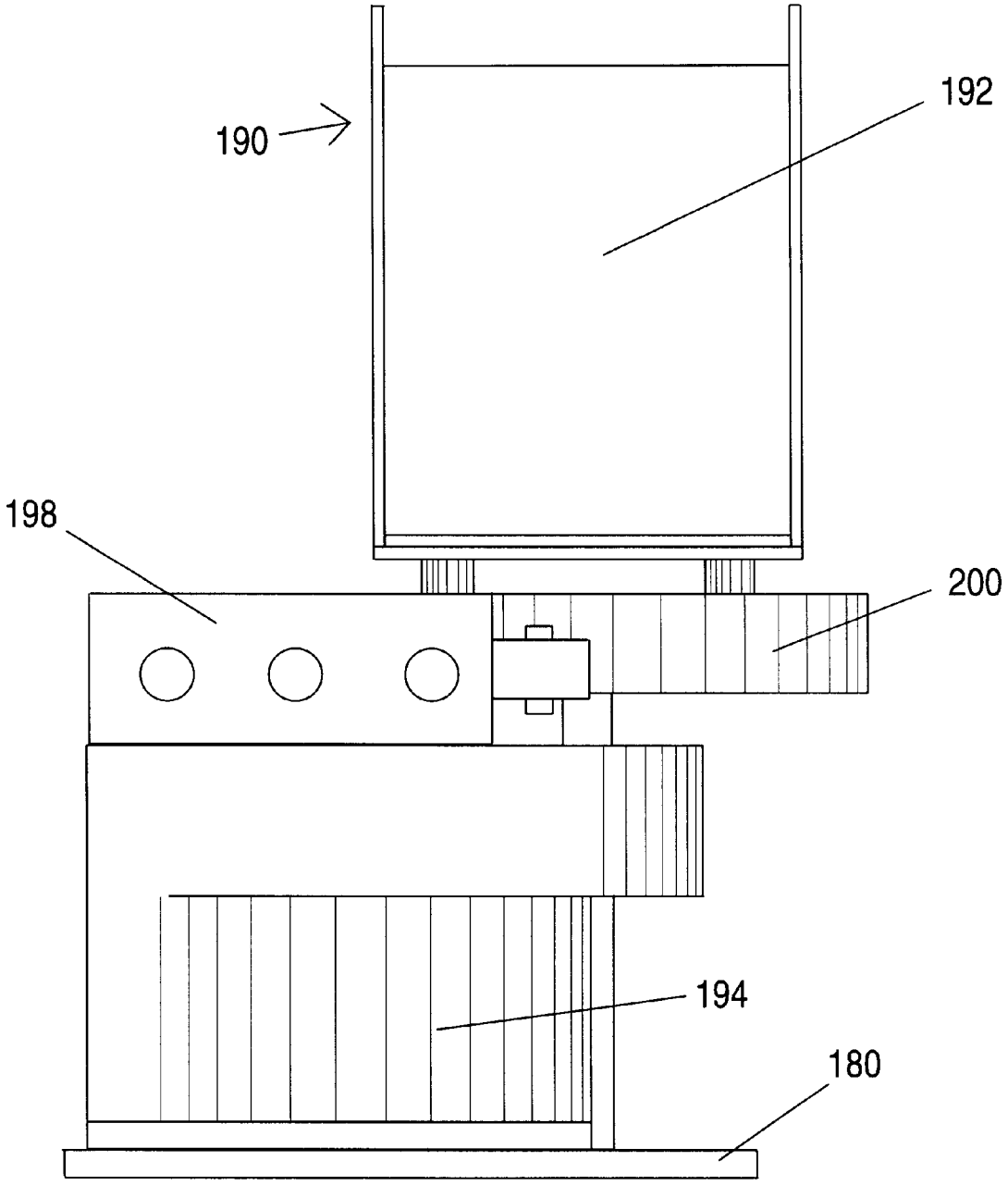
FIG. 12 is side elevation of the dispensing station shown in FIG. 11.
Figure 13:
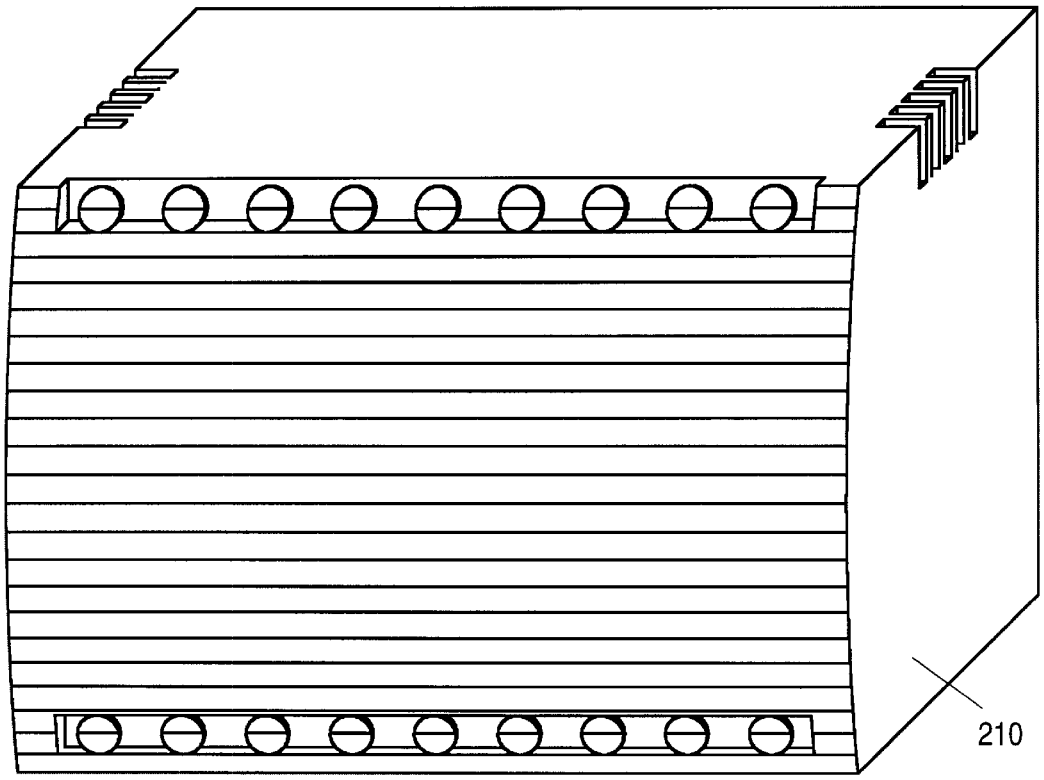
FIG. 13 is an enlarged isometric front view of the programmable logic controller or microprocessor used in the subject machine and shown in FIG. 1.

With reference to FIGS. 1, 2 and 3, each operating station 40 includes a coin accepting mechanism 58 of well known construction and which may be that supplied by the ESD company of Fort Washington, Pa. under a model No. V4. The coin accepting mechanism includes a sliding tray 60 providing a payment coin slot 62 and an unpressed coin slot 64. The coin accepting mechanisms are mounted in the side walls 36 of the cabinet and the trays are accessible from the outside of the cabinet. Each operating station also includes a lock-out solenoid 66 and a station activation switch 68. Furthermore, each operating station provides a cash tube 70 located within the cabinet next to each side wall and under the inner portion of its associated sliding tray. Each cash tube is aligned with and opens to a cash box 72 located at the bottom of the cabinet.

Each sliding tray 60 (FIGS. 1–3) is moveable between an outer coin-accepting position and an inwardly slid, coin-dropping position, provided that acceptable coins are placed in the slots 62 and 64. In the outer position, a payment coin, not shown, is placed in the coin slot 62 and an unpressed coin 50 is placed in the unpressed coin slot 64 whereupon the tray can be slid into the cabinet 32. Each lock-out solenoid 66 has a blocking position (FIGS. 1–3) with an arm projecting into the path of inward travel of its associated sliding tray 60 and a retracted position (not shown) with the arm retracted, allowing such inward travel. Each station activation switch 68 is located so as to be engaged by its associated sliding tray when the tray is allowed to move into its coin-dropping position.

As stated, the purpose of the subject machine 30 (FIG. 1) is to press an unpressed coin 50 into a pressed coin 52. Thus, there are pressed coin receptacles 74 in the side walls 36 individually located below the sliding trays 60 of their respective operating stations 40 and 48. In other words, when a customer activates the machine with both an unpressed coin 50 and a payment coin, not shown, in a sliding tray 60, the customer will receive the pressed coin 52 in the receptacle 74 immediately below the tray in which the unpressed coin was inserted.

The pressing station 44 (FIGS. 1, 4 and 5) includes a rotary coin press 80 of well known construction and thus is only generally described herein. A suitable press is sold by Eurolink Design Corporation of Grover Beach, Calif. 93433 as part No. 2QCM97. The press is supported on an intermediate shelf 82 of the cabinet 32 so that the press is located generally centrally of the cabinet below the operating stations 40, above the collecting stations 48, and substantially equidistantly spaced between the side walls 36. The press includes a stand 86 secured to the shelf and providing an intermediate passageway 88. Pressing rollers 90 are mounted on the stand in the passageway and are engraved with dies or images, not shown, for embossing on the unpressed coins 50 various designs, images and/or words, an example of which is shown in FIG. 18 at 54. A pressing motor 92 is mounted in the cabinet underneath the shelf 82 and has a drive gear 94 connected by a chain 96 (shown only in FIG. 4 for illustrative convenience) to a driven gear 98 that is connected to the pressing rollers. Intermediate drive gears 100 are connected to the pressing rollers and are in meshing engagement so that both of the rollers are driven by the gear 98. The press also includes an exit slide 104 located in the passageway and under the pressing rollers so that pressed coins 52 drop from the pressing rollers onto the slide from where they slide downwardly and through an opening 106 in the shelf. In the preferred embodiment the slide is a rectangular strip of brass to ensure that the dropped, pressed coin will slide by gravity into the opening.

The gating station 42 (FIGS. 1 and 8–10) includes a back panel 116, preferably a thin aluminum sheet, mounted to and extending transversely of the cabinet 32 between the side walls 36 just beneath the sliding trays 60, and a front panel 118, preferably a thin clear plastic sheet, mounted in forwardly, closely adjacent spaced relation to the back panel. The panels define a vertical slot 120 therebetween that is vertically aligned with and coplanar with the unpressed coin slots 64 in the sliding trays. Elongated inclined rails 122 are positioned between the panels in the slots, and thus coplanar with the coin slots 64, and extend downwardly from upper ends under the trays 60 to positions spaced transversely from each other centrally of the cabinet. The panels and the rails thus define delivery chutes 124 having upper ends 126 under their respective trays and lower ends 128 spaced from each other and located directly above the vertical passageway 88 of the press 80. Coins 50 dropping from the trays 60 (FIGS. 1, 8–10, 16) are thus constrained to drop into the slot 120 and onto the rails 122 of their respective delivery chutes 124 on which they roll to the lower ends 128. The front panels are transparent thereby allowing customers to see coins being processed through a window in the front wall of the cabinet, not shown, as is the custom in this art.

The gating station 42 (FIGS. 1, and 4–10) also includes a gating device 140 having upper holding gates 142 respectively associated with the delivery chutes 124 and a lower drop-timing gate 144 associated with the press 80. The upper holding gates include holding solenoids 146 having plungers extending through the panels 116 and 118 into thus through the slot 120 and individually associated with the lower ends 128 of the delivery chutes. A back stop 148 in the form of a small rectangular plate is sandwiched between the front and back panels 116 and 118 in the slot 120 intermediate and slightly above the plungers of the solenoids. The spacing between the plunger of each holding solenoid and its associated lower end of the delivery chute is less than the diameter of an unpressed coin 50, as will be evident by reference to FIGS. 8 and 16. When the coins roll down the chutes they enter the upper holding gates 142 where they engage the extended plungers of their respective solenoids 146. If a coin attempts to jump or roll over its plunger out of the holding gate, it strikes the back stop and falls back into its holding gate.

Figure 16:
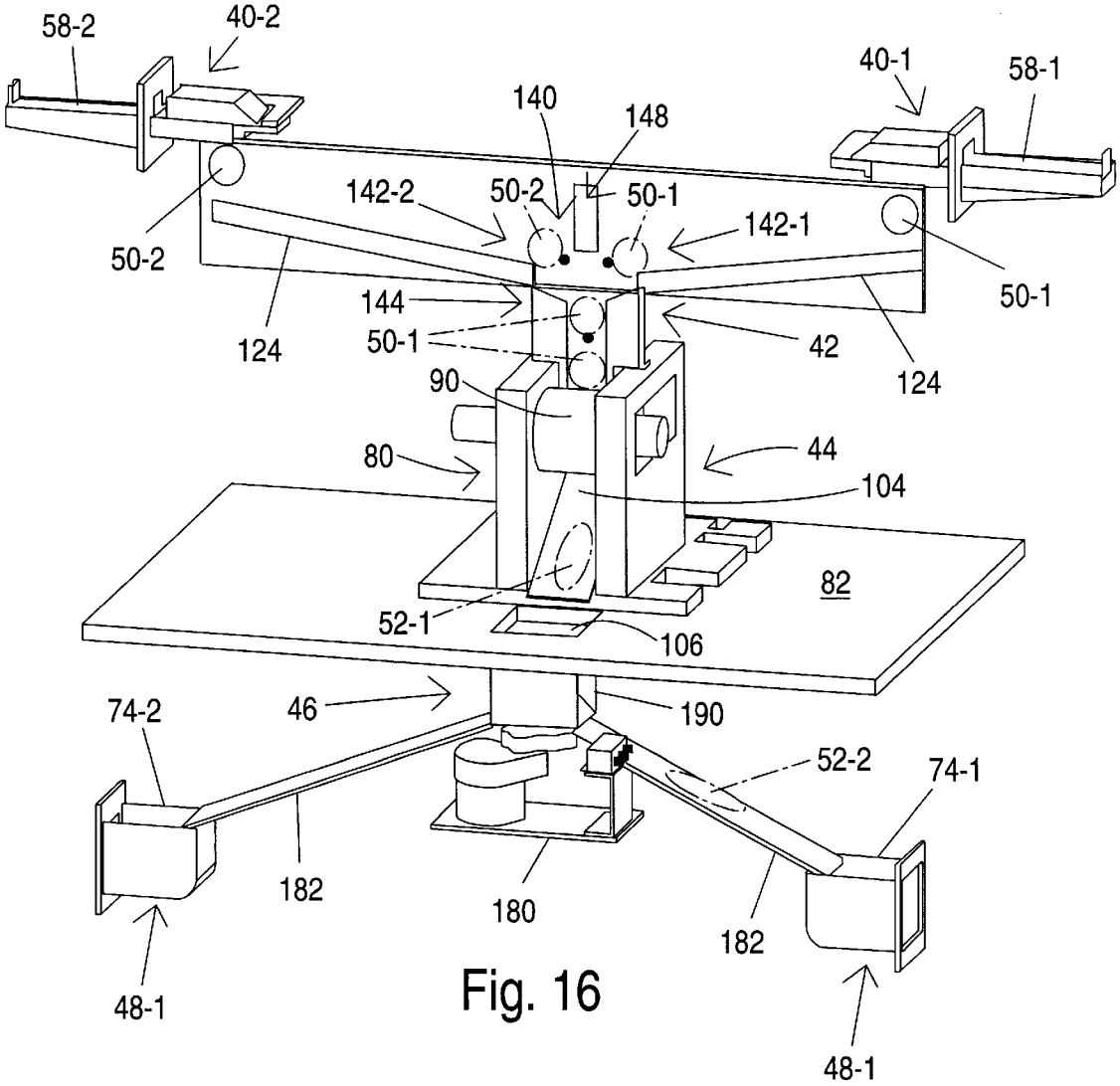
FIG. 16 is a schematic isometric view of the several processing stations of the embodiment of the machine shown in FIG. 1 and also showing unpressed and pressed coins or tokens in various positions as they move through the processing stations.

The drop-timing gate 144 (FIGS. 1, and 4–7) includes a pair of coplanar, vertical ramp plates 150 transversely spaced from each other to define a vertical gateway 152 in vertical alignment with the passageway 88 of the press 80. The ramp plates have upper inclined ramping edges 154 respectively aligned with the lower ends 128 of the delivery chutes 124. A back plate 156 extends between the ramp plates in forwardly spaced relation to the back wall 34 of the cabinet and in generally the same plane as the back panel 116. The plunger of a drop-timing solenoid 160 extends through the back plate and into the gateway equidistantly between the ramp plates and spaced from the vertical edges of the ramp plates by a distance less than the diameter of an unpressed coin 50, as illustrated in FIG. 16.

Figure 15:
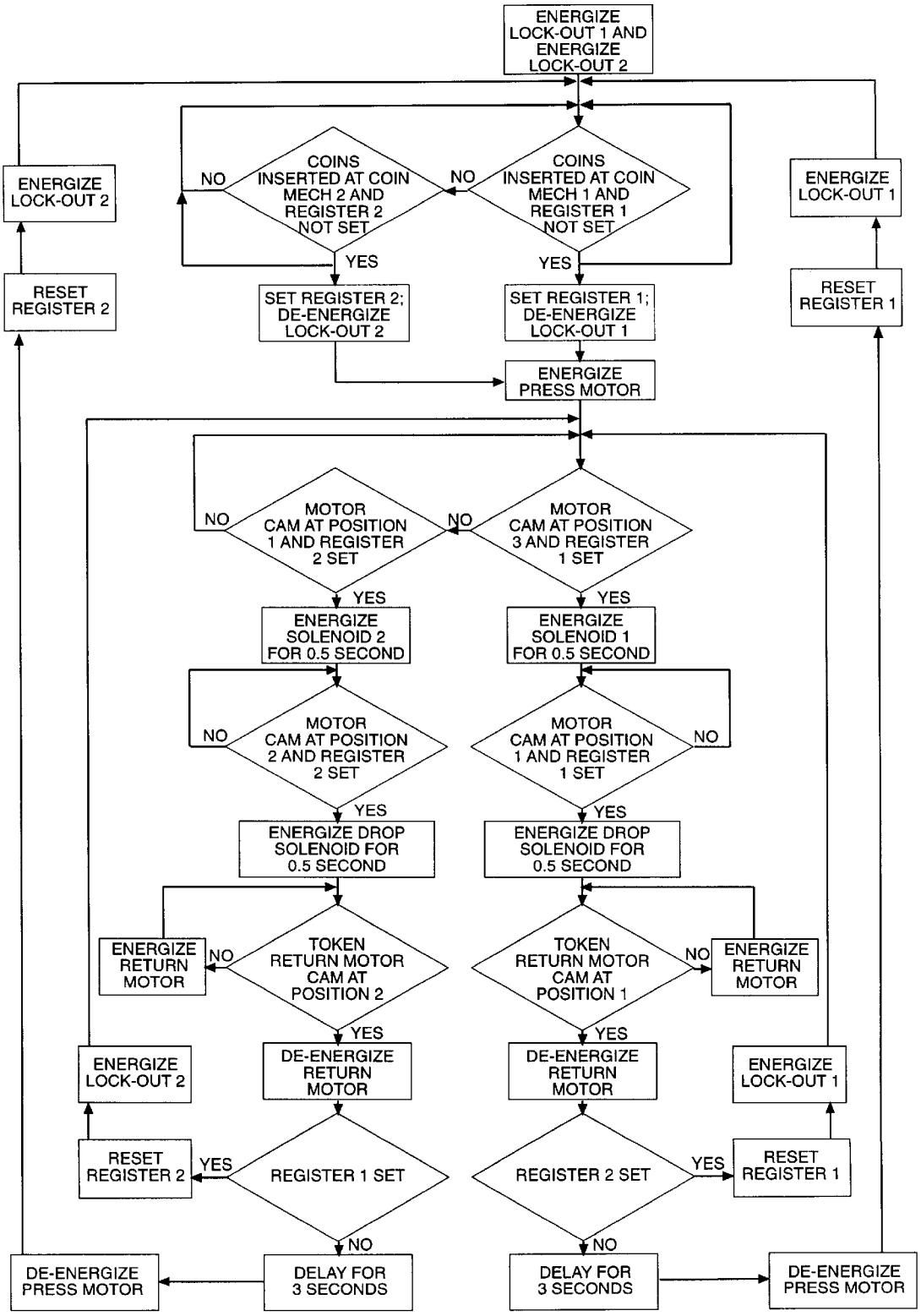
FIG. 15 is a flow chart showing functions that occur during operation of the subject machine.

The gating device 140 (FIGS. 1, 4 and 5) also includes a timing switch 170 and a timing cam 172. The timing cam is turned by the driven gear 98 of the press 80 and has three positions in the disclosed embodiment, these positions not being shown but identified in this description as 172-1, 172-2 and 172-3. The rise on the cam at position 172-1 controls either the drop-timing solenoid 160 or the holding solenoid 146; the rise on the cam at position 172-2 controls the drop-timing solenoid; and the rise in the cam at position 172-3 controls the holding solenoid, each of these actions depending on which part of the cycle the cam is in, as shown in FIG. 15. In these various positions of the timing cam, the cam thus engages the timing switch to activate the holding and timing solenoids 146 and 160.

The dispensing station 46 (FIGS. 1, 11 and 12) includes a platform 180 supported in a horizontal position within the cabinet 32. Dispensing chutes 182 have upper ends 184 supported from this platform and lower ends 186 that extend into the pressed coin receptacles 74 at the collecting stations 48. A rotary cup 190 is mounted on the platform below the opening 106 in the shelf 82 for rotation about a vertical axis. The cup has an inclined wall or bottom 192 alignable with the dispensing chutes 182 depending upon the rotational position of the cup. Thus, the cup is positioned to receive pressed coins 52 sliding down the slide 104 and dropping through the opening 106. Depending upon the position of the bottom of the cup relative to the dispensing chutes, the pressed coin is thus guided to slide into the receptacle 74 associated with the tray in which the related unpressed coin was inserted into the machine. A dispensing or return motor 194 is mounted on the platform 180 and is connected to the rotary cup 190 for moving the cup between its dispensing positions. A dispensing switch 198 is also mounted on the platform in a position to be contacted by a dispensing cam 200 that is driven by the motor. When the motor moves the cup into one of its dispensing positions, the cam engages the dispensing switch to turn off the motor and stop the cup in the desired dispensing position.

Figure 14:
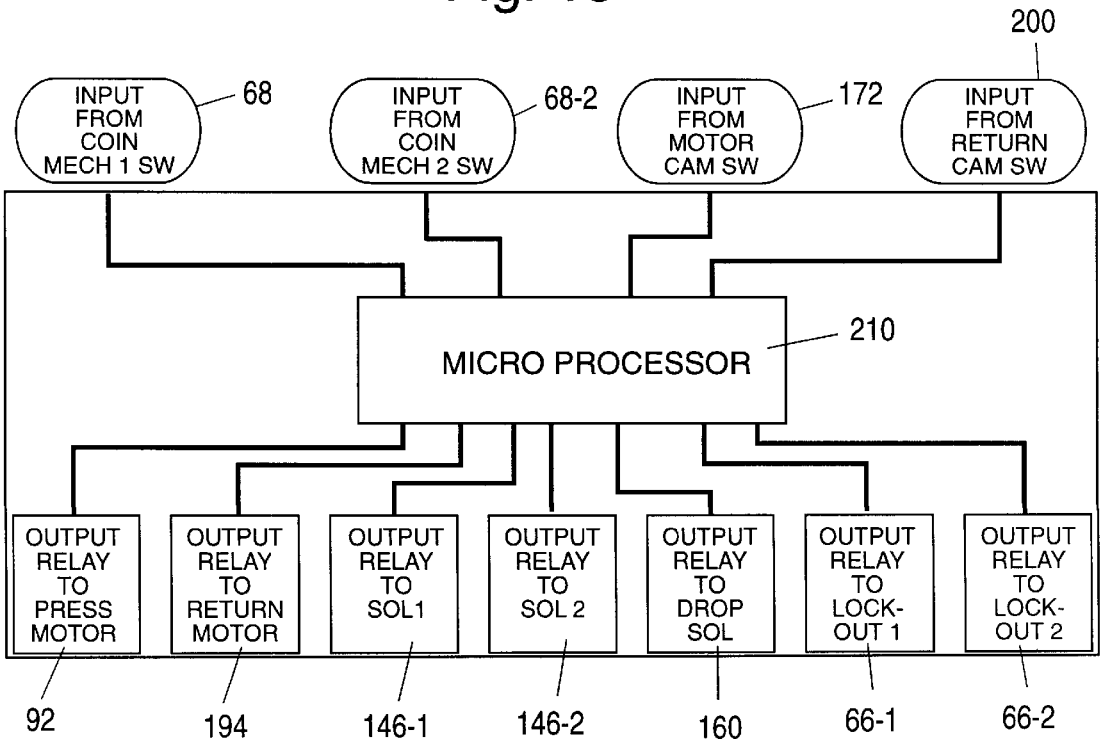
FIG. 14 is a block diagram showing the relationships between the programmable logic controller and other elements of the subject machine.

The coin pressing machine 30 (FIGS. 1, 13 and 14) also includes a programmable logic controller or microprocessor 210 that controls the sequence of operations of the subject machine. A suitable controller for the subject machine is sold by PLC Direct of Cumming, Ga., as part No. 8 DL 105. The controller is mounted within the cabinet 32 and as shown in FIG. 14, receives inputs from the station activation switches 68, the timing switch 170, and the dispensing switch 198. In turn, the controller has outputs to the pressing motor 92, the dispensing or return motor 194, the holding solenoids 146, the drop-timing solenoid 160, and the lock-out solenoids 66.

Figure 19:
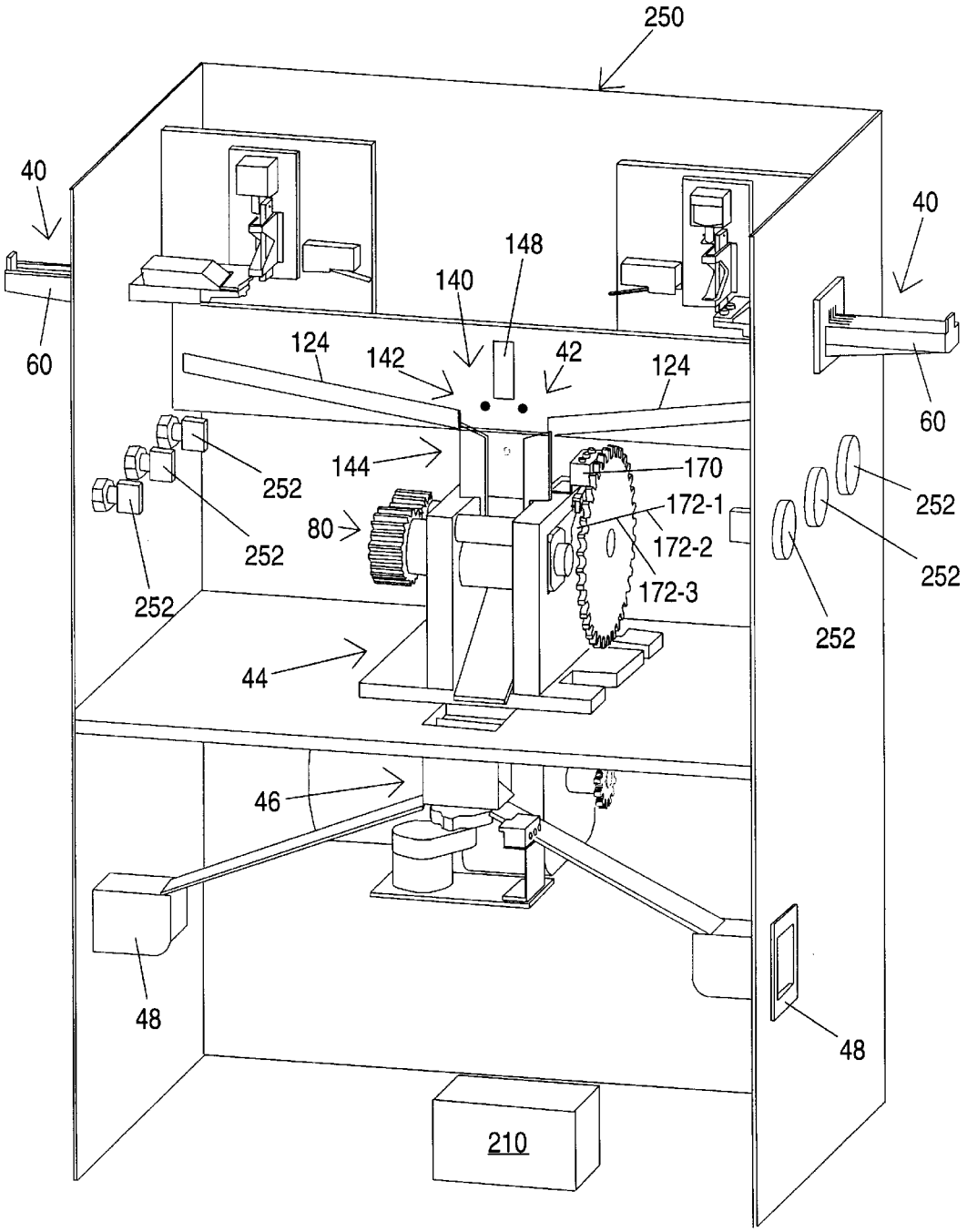
FIG. 19 is an isometric view similar to FIG. 1 but showing a second embodiment of the subject machine that allows customers to select certain images or designs to be impressed on the coin or token.

A second embodiment of the coin pressing machine is shown in FIG. 19 and identified by the number 250. In this embodiment a plurality, three as shown, of detentable, push-button switches 252 are mounted in the side walls 36 of the cabinet 32 under each operating station 40. Each of these switches controls the activation of the drop-timing solenoid 160 so as to drop an unpressed coin 50 into the press 80 at such a time as it will be embossed with a particular image or design on the pressing rollers 50 associated with the switch 252 that is pushed.

Figure 20:
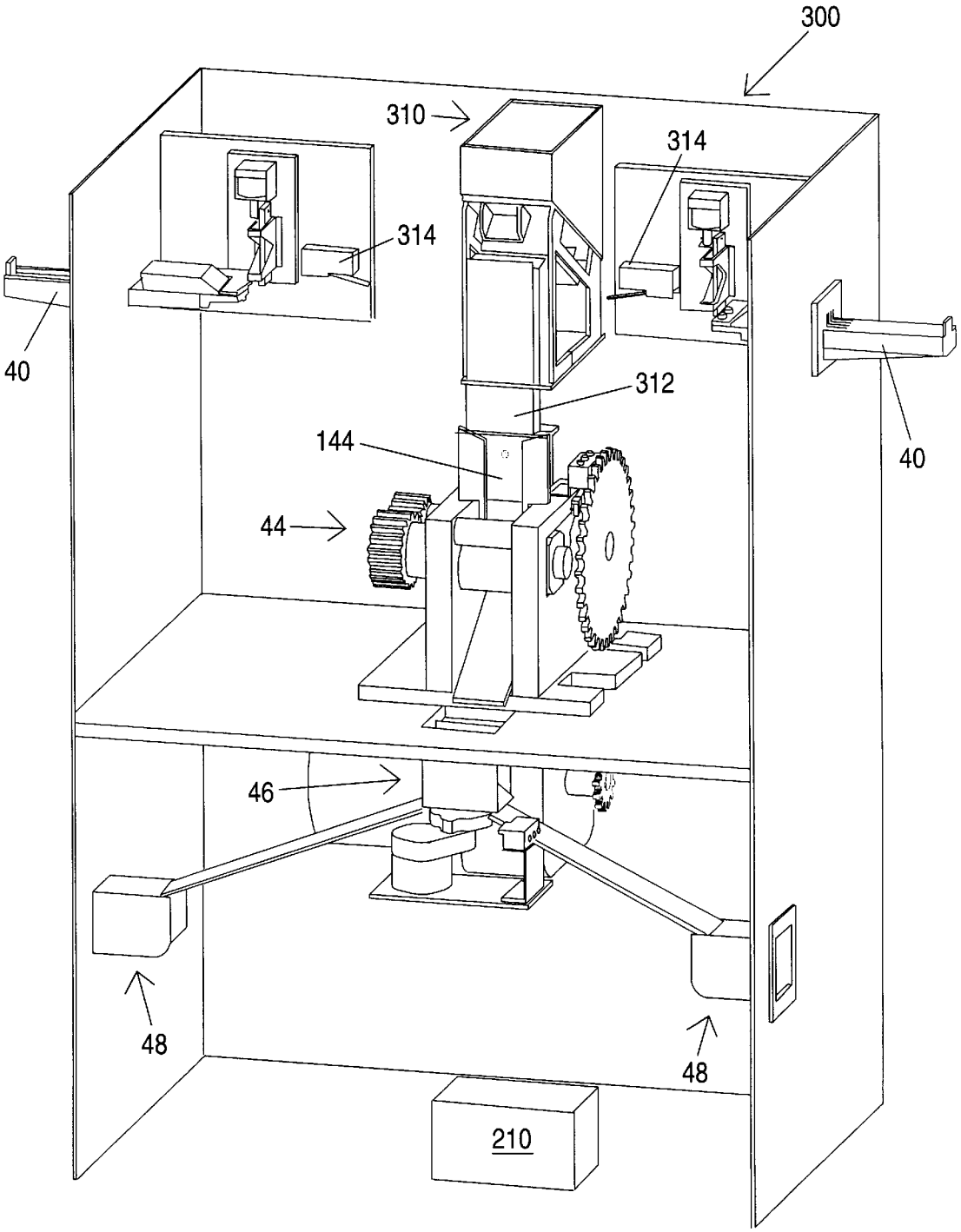
FIG. 20 is an isometric view similar to FIG. 1 but showing a third embodiment of the subject machine that includes a token hopper.
Figure 21:
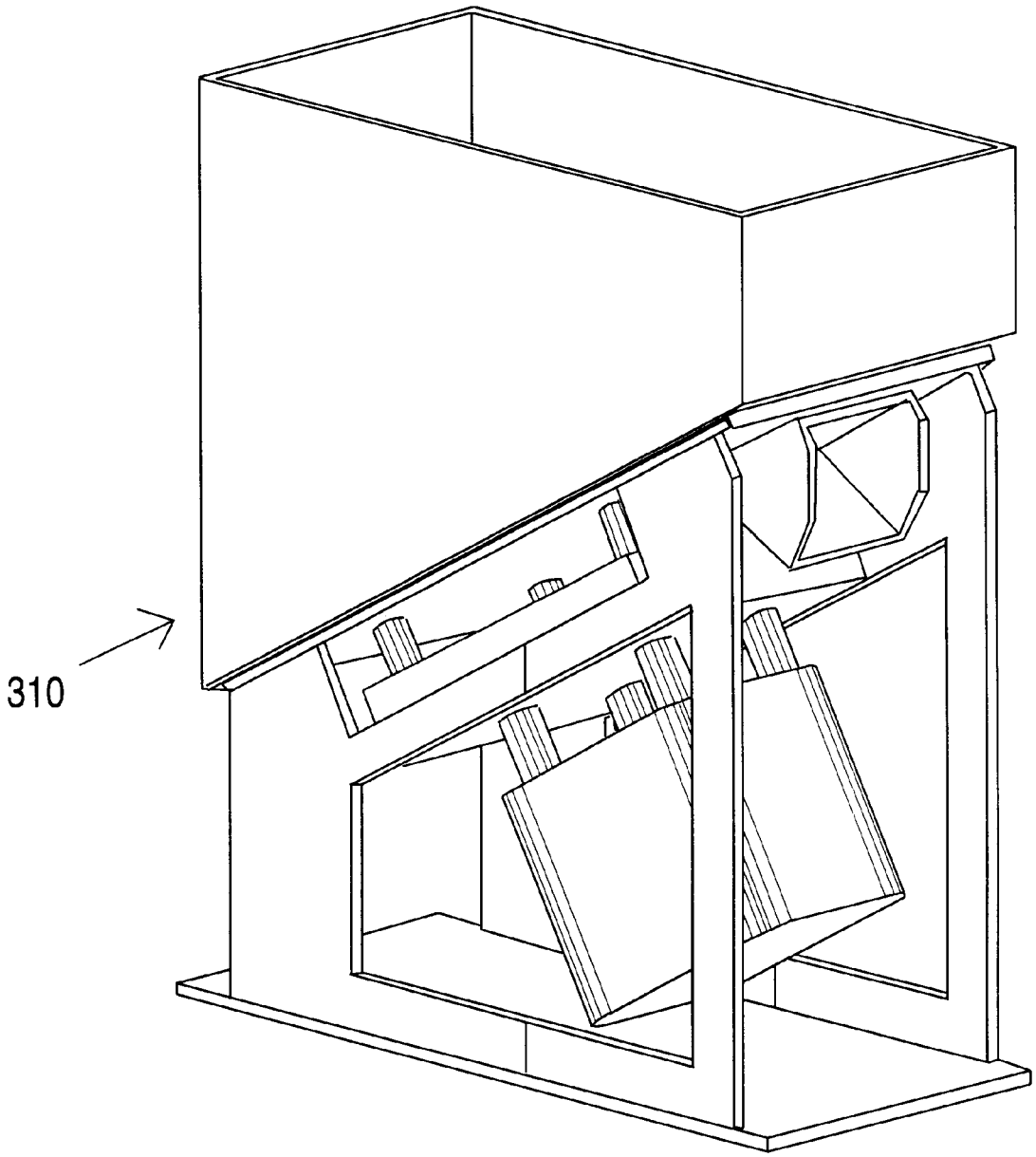
FIG. 21 is an enlarged front isometric view of the token hopper shown in FIG. 20.

A third embodiment of the subject machine is identified by the numeral 300 in FIGS. 20 and 21. This embodiment differs from the machines 30 and 250 in the first and second embodiments only in that the machine supplies tokens 50 to-be-pressed instead of coins from the customer. In this third embodiment therefore, a token hopper 310 is mounted on the back wall 34 and has a transfer chute 312 aligned with the gateway 152 between the ramp plates 150 of the drop-timing gate 144. This third embodiment thus does not use the delivery chutes 124 nor the upper holding gates 142 since these are used in the first embodiment to deliver unpressed coins supplied by the customer in a timed manner to the press 80. Further, the third embodiment uses station activation switches 314 that have an additional function as compared with the station activation switches 68. When the switches 314 are engaged by the inwardly sliding trays 60, they energize a solenoid, not shown, in the token hopper 310 thereby to release an unpressed token 50 into the transfer chute 312 through which it is guided down to the drop-timing gate 144.

OPERATION AND DESCRIPTION OF THE METHOD

The operation of the machine 30 and the method of the subject invention are now described having particular reference to FIGS. 1 and 14–16. The machines 250 and 300 of the other embodiments will be referred to during the description insofar as the differences among these three embodiments are concerned. In describing the operation and the method, reference numerals -1 and -2 will be used to distinguish between the two operating and collecting stations 40 and 48 and their associated parts of the machine, e.g., 40-1, 48-1, 40-2, and 48-2. For convenience, the operating and collecting stations on the right side of FIG. 1 will be referred to by adding -1 to their reference numeral, and the operating and collecting stations on the left side of FIG. 1 will be referred to by adding -2 to their reference numerals. Note that the timing cam 172 in the gating device uses -1, -2, and -3, but these refer to positions of the cam and not to the operating or collecting stations.

When the machine 30 or 250 or 300 (FIGS. 1 and 14–16) is powered by connecting the controller 210 to a source of power, and before being operated by customers, the lock-out solenoids 66-1 and 66-2 are energized so that they do not block the inward sliding movement of the trays 60. Note that the first block at the top of the flow chart of FIG. 15 indicates that both of these lock-out solenoids are energized thereby preparing the machine for use by customers. The machine is activated by a customer inserting a payment coin, not shown, and an unpressed coin 50 in the tray 60-1 or 60-2, or both, and shoving the tray into the cabinet. Assuming that two customers desire to use or "play" the machine at the same or substantially same time, each customer inserts a payment coin, not shown, and an unpressed coin 50 in the token slots 62 and 64 of the sliding tray at customer's operating station 40-1 or 40-2. If the embodiment of the machine 300 is used, only a payment coin is inserted.

Inward sliding movement of either tray 60-1 or 60-2 (FIGS. 1 and 14–16) causes the associated station activation switch 68 to close, thereby initiating a cycle of operation of the controller 210. Closing the station activation switch also sets the associated register 1 or 2 in the controller. If the machine 250 is used, the customer at this time has the option of selecting one of three different images or designs to emboss on the unpressed coin 50-1 or 50-2. Thus, after inserting the payment coin and pushing the tray into the cabinet 32, the customer pushes one of the push-button switches 252 depending on the design selected. The switches control when the timing cam 172 activates the drop-timing switch, thereby controlling when the unpressed coin 50-1 or

50-2 is released into the press 80. If the machine 300 is used, the customer does not insert an unpressed coin, but the station activation switches 314 respectively cause tokens to be dispensed from the hopper 310.

When the controller 210 starts its scanning cycle (FIGS. 1 and 14–16), it first scans the register 1 and then the register 2. If register 1 is set, then the unpressed coin 50-1 inserted at station 40-1 will be the first-to-be-pressed. If register 2 is set and register 1 is not, then the unpressed coin 50-2 at station 40-2 will be the first-to-be-pressed. In the description to follow, it is assumed that register 1 is set when the controller starts its scan so that the unpressed coin 50-1 at operating station 40-1 will be the first-to-be-pressed irrespective of whether an unpressed coin 50-2 has been inserted at the operating station 40-2. However, in order to describe how the machine is able to handle multiple coins from multiple stations, it is also assumed that an unpressed coin 50-2 has been inserted into the machine at operating station 40-2, either at about the same time as the coin 50-1 or at exactly the same time. The important point to note here is that where there is simultaneous operation of the machine, the controller controls which coin will be first to be pressed; where there is near simultaneous operation, the first payment coin inserted together with the controller insures that the unpressed coin associated with the first payment coin will be pressed first.

Thus, the unpressed coins 50-1 and 50-2 (FIGS. 1 and 14–16) both drop from their respective sliding trays 60, at about, or exactly at, the same time, into the delivery chutes 124 and onto the rails 122 on which they roll downwardly to the upper holding gates 142. Since these gates are both normally closed and thus are closed at this time, the unpressed coins are held in these gates awaiting control signals to release the coins in the order in which their associated payment coins were inserted in the machine or, if simultaneously inserted in the machine, in the order in which the controller scans the stations 40-1 and 40-2.

When closure of the station activation switch 68-1 starts the scanning cycle of the controller 210 (FIGS. 1 and 14–16), the controller deenergizes the lock-out solenoid 66-1 at the same time as register 1 is set (FIGS. 14, 15). Thus, this lock-out solenoid temporarily blocks inward sliding movement of the tray 60-1 (FIG. 2), thereby temporarily disabling further operation of the machine from station 40-1 by a successive unpressed coin 50-1 until the unpressed coin 50-1 previously inserted into the machine at this station has completed its pressing operation.

After register 1 in the controller 210 (FIGS. 1 and 14–16) has been set and the lock-out solenoid 66-1 has been denergized, the controller causes the pressing motor 92 to be energized (FIG. 15) whereby the timing cam 172 is rotated. If this cam is at its position 172-3 and the register 1 has been set (FIG. 15), the holding solenoid 146-1 is energized for 0.5 second, thereby opening its associated upper holding gate 142-1, and releasing the unpressed coin 50-1 to fall into the drop-timing gate 144, which is closed at this time.

The coin 50-1 is held in the drop-timing gate 144 (FIGS. 1 and 14–16) until the timing cam 172 reaches its position 172-1, and at that time the drop-timing solenoid 160 is energized for 0.5 second (FIG. 15) to open the drop-timing gate and release the coin 50-1 into the press 80. The drop-timing gate is opened when the die on the pressing rollers 90 is positioned to engage the coin when it drops from the gate into the press. That is, the timing between position 172-3 and position 172-1 of the timing cam 172 is such as to retract the drop-timing solenoid so that the unpressed coin will drop just in time to be embossed by the engraved design on the roller 90.

If the machine 250 (FIG. 19) is used, the customer, by pushing one of the push-button switches 252, actually selects one of three different die-selection switches, not shown, each of which is in the circuit with the timing switch 170. Depending on which selection switch is closed and thus placed in the circuit by pushing a button switch 252, the drop-timing solenoid will open the drop-timing gate 144 at a different time that is related to the image or design selected. The rise on the timing cam 172 at position 172-1 is shaped to allow for this selectivity so that although the timing switch is closed by the cam, only the selection switch that is closed by the push-button switch 252 will cause activation of the drop-timing solenoid. The coin 50-1 is thus pressed between the rollers 90, and the pressed token 52-2 drops onto the slide 104 where it slides down through the opening 106 to the rotary cup 190.

When register 1 (FIGS. 1 and 14–16) is initially set by closure of the station activation switch 68-1, the dispensing motor 194 is energized to move the dispensing cam 200 into its position 200-1 (FIG. 15) whereby the bottom 192 of the rotary cup 190 is aligned with the dispensing chute 182-1. Thus, when the pressed coin 52-1 drops into the cup, it immediately slides down the bottom onto the dispensing chute 182-1 and into the token receptacle 174-1. Also, when the bottom is aligned with the dispensing chute 182-1, the dispensing motor 194 is denergized (FIG. 15).

When the dispensing motor 194 (FIGS. 1 and 14–16) has been positioned to deliver the pressed token 52-1 to the receptacle 74-1, the machine 30 (or 250 or 300) is ready to press a token 50-1 in the holding gate 142-1. Thus, after the dispensing or token return motor 194 is denergized (FIG. 15), if the register 2 has been set, thereby indicating that a coin 50-2 from station 40-2 is in the machine, the controller will initiate a second cycle of operation for the unpressed coin 50-2. Also the controller resets register 1 and energizes the lock-out solenoid 66-1 thereby to allow another unpressed coin 50-1 to be inserted into the machine at station 50-1.

In continuing its second cycle of operation, the controller 210 (FIGS. 1 and 14–16) will be unable to open the upper holding gate 142-1 if there is a coin 50-2 in the upper holding gate 142-2. Since the timing cam 172 will have moved past its position 172-3 and into its position 172-1, and since the register 2 will have been set by the tray 60-2 engaging the activation switch 68-2, the timing switch 170 will activate only the left holding solenoid 146-2 to open the gate 142-2. At the same time, the dispensing motor 194 is energized to rotate the dispensing cup 190 into a position where the bottom 192 is aligned with the dispensing chute 182-2, where the dispensing or token return motor is again denergized.

The coin 50-2 thus drops from the holding gate 142-2 (FIGS. 1 and 14–16) down onto the drop-timing gate 144. When the timing cam 172 is in its position 172-2, the timing solenoid 160 opens the drop-timing gate 144 to release the coin 50-2 into the press 80. Note that if machine 250 is used, the same image or design selection action occurs at station 40-2 as described above for station 40-1. The unpressed coin 50-2 is thus pressed into a pressed coin 52-2 in the same manner as discussed above with regard to the coin 50-1. This pressed coin 52-2 is dropped onto the slide 104 from which it slides through the opening 106 in the shelf into the dispensing cup 190, onto its bottom 192, and then onto the dispensing chute 182-2 into the token receptacle 74-2.

After pressing either coin 50-1 or 50-2 (FIGS. 1 and 14–16), if the other register 2 or 1 is not set, the pressing motor 92 is denergized, the corresponding register is reset, the associate lock-out solenoid 66 is reenergized, and the machine 30 is ready for subsequent use by one or two customers at either or both of the operating stations 40-1 or 40-2.

As is believed understood from the foregoing description, the machine 300 operates in a similar manner to the machine 30 except that when a payment coin, not shown, is inserted into the machine through one of the sliding trays 60, the associated station activation switch 68, in addition to initiating the cycle of operation of the controller 210, energizes a solenoid, not shown, in the token hopper 310 to cause a token 50 to be dispensed through the chute 312 and into the drop-timing gate 144.

It will be understood from the foregoing that a machine and method has been shown and described for producing pressed items from unpressed coins, tokens, and like items. The machine 30 includes multiple operating stations 40 from where multiple operators can activate or play the machine; a press 80 adapted to press unpressed coins, tokens, and like items delivered to it and to release pressed items therefrom; multiple collecting stations 48 adapted to receive pressed items; a gating device 140 that delivers unpressed coins to the press in a predetermined order, preferably in the order that the machine was activated and in response to activation of the machine at the operating stations; and a dispenser 182, 190 that delivers pressed items from the press to the collecting stations in a predetermined manner, preferably to the collecting stations adjacent to the station where the machine was activated resulting in the pressed coin. The method disclosed involves activating the machine at multiple operating positions so that more than one unpressed coin associated with different operating stations can be in the machine awaiting pressing at the same time; determining the order in which the operating positions were activated; and pressing the coins or tokens awaiting pressing in a predetermined order, preferably the order in which their associated customer activated the machine.

The accompanying drawings taken with the foregoing description show that the subject invention enables a coin or token pressing machine to be operated from multiple positions and that an order of pressing unpressed coins is established in a multi-station coin pressing machine so that only one coin or token is pressed at a time. The principles of this invention enable movements of unpressed and pressed coins to be controlled as the coins or tokens pass through the machine so that the unpressed coins will be pressed substantially in the order in which they were released into the machine for pressing and will be delivered to their customer at locations adjacent to where the machine was activated by the customer.

As a result of the invention, the following advantages are achieved: the throughput of a coin or token pressing machine is greatly increased thereby making the ownership and operation of a coin or token pressing machine more profitable; the time that customers have to wait to play the machine is minimized; damage and breakdown of a coin or token pressing machine or improper functioning of the machine caused by admission of more than one coin or token in the press of the machine at the same time is avoided; pressed coins that have sharp, jagged edges that may be dangerous for customers to handle are eliminated; and pressing of a customer's coin or a common blank token and selection of various images or designs to be embossed on the coin or token are accommodated. A significant feature of the invention is that the machine is controlled, and thus the described control of the movements of the coins is achieved, by a programmable logic computer.

Although preferred embodiments of the present invention have been shown and described, various modifications and substitutions may be made thereto without departing from the spirit and scope of the present invention. Accordingly, it is to be understood that the present invention has been described by way of illustration and not limitation.

What is claimed is:

1. A machine for producing pressed items from coins or tokens comprising, first and second operating stations from where multiple operators can activate the machine;

a press adapted to press coins or tokens delivered to it and to release pressed items therefrom;

first and second collecting stations adapted to receive items that have been pressed;

a gating device that delivers items to be pressed to the press in a predetermined order and in response to activation of the machine at the operating stations; and a dispenser that delivers pressed items from the press to the collecting stations in a predetermined manner.

2. The machine of claim 1, wherein there is a controller that causes items to be released from the gating device to the press in said predetermined order and that causes pressed items released from the press to be dispensed to the collecting stations in said predetermined manner.

3. The machine of claim 2, wherein the controller causes the gating device to release an item to the press in response to activation of the machine at the operating station so that each item delivered by the gating device to the press is associated with a single activation of the machine at one of the operating stations.

4. The machine of claim 2, wherein each item delivered by the gating device to the press is associated with a single activation of the machine at one of the operating stations;

wherein there is a collecting station associated with each operating station; and wherein the controller causes the dispenser to release each pressed item to the collecting station corresponding to the operating station that is associated with the particular item that has been pressed.

5. The machine of claim 2, wherein the controller causes the gating device to release an item to the press in response to activation of the machine at the operating station so that each item delivered by the gating device to the press is associated with a single activation of the machine at one of the operating stations;

wherein there is a collecting station associated with each operating station; and wherein the controller causes the dispenser to release each pressed item to the collecting station corresponding to the operating station that is associated with the particular item that has been pressed.

6. A machine that can be actuated from multiple positions for producing pressed items from coins or tokens comprising, first and second operating stations at such multiple positions where the machine can be actuated to cause an item to be pressed to be available for pressing;

a press located sequentially after the operating stations and adapted to press such an item into a pressed item;

a gating device located sequentially before the press adapted to receive such items to be pressed in response to activation of the machine at the operating stations, temporarily to hold the items, and subsequently to release them for movement into the press at a predetermined time;

first and second collecting stations located sequentially after the press and respectively associated with the operating stations for collecting pressed items from the press; and a transfer device located sequentially after the press and adapted to deliver each pressed item to one of the collecting stations.

7. The machine of claim 6, wherein there is a controller that causes the gating device to release items to the press in the order in which the items were received at the gating device.

8. The machine of claim 6, wherein there is a controller that causes the transfer device to deliver each pressed item to the collecting station associated with the operating station that caused the particular item to move into the gating device.

9. The machine of claim 6, wherein there is a controller that causes the gating device to release items to the press in the order in which the items were received at the gating device and that causes the transfer device to deliver each pressed item to the collecting station associated with the operating station that caused the particular item to move into the gating device.

10. The machine of claim 6, wherein the gating device includes a timing gate located before the press adapted initially to hold an item to be pressed and subsequently to release the item into the press, and wherein the gating device also includes holding gates located before the timing gate respectively associated with the operating stations and adapted to receive such items to be pressed as a result of actuation of the machine at their associated operating stations, temporarily to hold the items, and subsequently to release them to the timing gate.

11. The machine of claim 6, wherein the transfer device includes a movable receptacle located sequentially after the press and adapted to receive pressed tokens from the press, to move into registry with one of the collecting stations, and to dispense the pressed tokens into one of the collecting stations.

12. The machine of claim 6, wherein the gating device includes a timing gate located before the press adapted initially to hold an item to be pressed and subsequently to release the item into the press and holding gates located before the timing gate respectively associated with the operating stations and adapted to receive such items to be pressed as a result of actuation of the machine at their associated operating stations, temporarily to hold the items, and subsequently to release them to the timing gate;

wherein the transfer device includes a movable receptacle located sequentially after the press and adapted to receive pressed tokens from the press, to move into registry with one of the collecting stations, and to dispense the pressed tokens into one of the collecting stations; and wherein a controller controls the gating device to cause items to be pressed to enter the press in the order in which the items entered the machine as a result of actuation thereof at the operating stations and controls the transfer device to move the receptacle into registry with the collecting station associated with the operating station from where the machine was actuated to cause the particular pressed item to enter the machine.

13. A machine that can be actuated from multiple positions for producing pressed items from coins or tokens comprising, a cabinet;

slideable, coin-receiving trays at multiple locations around the cabinet each capable of causing a coin or a token to be available for pressing within the cabinet when a payment coin is placed in the tray and the tray is slid into the cabinet;

pressed-token-collecting receptacles mounted at opposite sides of the cabinet individually below the trays;

dispensing chutes sloping upwardly from the receptacles toward the center of the cabinet;

a cup rotatably mounted within the cabinet intermediate the receptacles and having a ramp alignable with selected chutes upon rotatable movement of the receptacle;

a slide sloping upwardly from the cup;

a press mounted within the cabinet above the slide, operable to press said available coins or a tokens dropped into the press into pressed tokens, and to drop the pressed tokens onto the slide;

a gating device mounted within the cabinet above the press operable to drop an available coin or a token into the press at a predetermined time after a payment coin is slid into the cabinet in a coin-receiving tray and has thereby made such coin or token available for pressing; and a programmable logic controller operable to cause an available coin or token to be dropped into the press in the order in which its associated payment coin is slid into the cabinet on one of the trays.

14. The machine of claim 13, wherein each tray is capable of receiving both a payment coin and a pressing coin; and wherein there are delivery chutes individually sloping downwardly from the trays to the gating device that are adapted to deliver pressing coins to the gating device after a payment coin and a pressing coin are slid into the machine on the trays.

15. The machine of claim 14, wherein the gating device includes a drop-timing gate above the press adapted initially to hold a pressing coin and subsequently to release the pressing coin into the press through the entrance thereof; and holding gates above the drop-timing gate individually located in the delivery chutes, each holding gate being adapted to receive pressing coin from its associated tray, temporarily to hold the pressing coin, and subsequently to release the same to the drop-timing gate depending in the order in which its associated payment coin was slid into the cabinet in relation to a payment coin being slid into the cabinet at another tray.

16. The machine of claim 13, wherein each tray is capable of receiving a payment coin;

a common token hopper mounted in the cabinet above the gating device; and wherein there is a delivery chute extending from the hopper to the gating device that is adapted to deliver a token-to-be-pressed from the hopper to the gating device when a payment coin is slid into the cabinet on one of the trays.

17. A method of operating a machine that presses coins or tokens so that the machine can be operated from multiple operating positions of the machine, comprising:

activating the machine at more than one of said multiple operating positions so that more than one coin- or token-to-be-pressed associated with different operating positions is in the machine awaiting pressing at the same time;

determining the order in which said operating positions were activated; and pressing the coins or tokens awaiting pressing in a predetermined order.

18. The method of claim 17, wherein the pressing of the coins or tokens is in the order in which their associated operating positions were activated.

19. The method of claim 17 including, dispensing pressed tokens at multiple collecting positions of the machine.

20. The method of claim 18, wherein the dispensing of each pressed token is to a collecting position relatively adjacent to the operating position associated with the pressed token.

21. A method of operating a machine that presses coins or tokens so that the machine can be operated from multiple operating positions of the machine, comprising:

activating the machine by inserting a payment coin into the machine at more than one of said multiple operating positions, causing a coin- or a token-to-be-pressed to enter the machine associated with each activation by a payment coin so that more than one coin- or token-to-be-pressed associated with different operating positions is in the machine awaiting pressing at the same time;

holding the coins- or tokens-to-be-pressed at a first holding gate;

releasing the coin- or token-to-be-pressed from the first holding gate the order in which their associated operating positions were activated;

pressing the coins or tokens that are released from the first holding gate.

22. The method of claim 21 including:

holding the coins- or tokens-to-be-pressed at a second timing gate after they are released from the first timing gate; and releasing the coins or tokens from the second timing gate at predetermined times related to the times at which they are to-be-pressed in the pressing step.

23. A machine for producing pressed items from coins or tokens comprising, means at first and second operating stations for receiving a payment coin to operate the machine whereby multiple operators can activate the machine to obtain pressed items;

means for pressing coins or tokens delivered to it and to release pressed items therefrom;

means at first and second collecting stations for collecting pressed tokens;

gating means for delivering items to be pressed to the press at a predetermined time and in response to activation of the machine at the operating stations; and means for dispensing pressed items from the press to the collecting stations in a predetermined manner.

24. The machine of claim 23, including programmable means for controlling the gating means whereby the items to be pressed are delivered to the press in the order in which their associated payment coin caused activation of the machine.

25. The machine of claim 23, wherein there is a collecting means associated with each receiving means; and including programmable means for controlling the dispensing means whereby the pressed items are delivered to the collecting means associated with the receiving means at which the associated payment coin was received.

26. The machine of claim 23, wherein there is a collecting means associated with each receiving means;

wherein there is a programmable means for controlling the gating means the dispensing means, whereby the items to be pressed are delivered to the press in the order in which their associated payment coin caused activation of the machine, and the pressed items are delivered to the collecting means associated with the receiving means at which the associated payment coin was received.

* * * * *